US010519601B2

(12) United States Patent
Shannon et al.

(10) Patent No.: US 10,519,601 B2
(45) **Date of Patent: *Dec. 31, 2019**

(54) HIGHLY DURABLE TOWEL COMPRISING NON-WOOD FIBERS

(71) Applicant: Kimberly-Clark Worldwide, Inc., Neenah, WI (US)

(72) Inventors: Thomas Gerard Shannon, Neenah, WI (US); Richard Louis Underhill, Neenah, WI (US); Kevin Leon LaBerge, Sherwood, WI (US); John Matthew Reiser, Snellville, GA (US); Gilbert Darrell Gafford, Cumming, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/173,474

(22) Filed: Oct. 29, 2018

(65) Prior Publication Data

US 2019/0100878 A1 Apr. 4, 2019

Related U.S. Application Data

(63) Continuation of application No. 15/574,331, filed as application No. PCT/US2015/033175 on May 29, 2015, now Pat. No. 10,145,066.

(51) Int. Cl.

| | |
|---|---|
| ***D21H 11/12*** | (2006.01) |
| ***A47K 10/16*** | (2006.01) |
| ***D21H 27/00*** | (2006.01) |
| ***D21H 27/38*** | (2006.01) |
| ***D21H 11/00*** | (2006.01) |
| ***A47K 7/00*** | (2006.01) |

(52) U.S. Cl.

CPC ..... *D21H 11/12* (2013.01); *A47K 7/00* (2013.01); *A47K 10/16* (2013.01); *D21H 11/00* (2013.01); *D21H 27/002* (2013.01); *D21H 27/005* (2013.01); *D21H 27/007* (2013.01); *D21H 27/38* (2013.01)

(58) Field of Classification Search

CPC .... D21H 27/002; D21H 27/30; D21H 25/005; D21H 27/005; D21H 27/38; D21H 11/12; A47K 10/16; A47K 7/00

See application file for complete search history.

(56) References Cited

U.S. PATENT DOCUMENTS

| | | | |
|---|---|---|---|
| 4,300,981 | A | 11/1981 | Carstens |
| 5,320,710 | A | 6/1994 | Reeves et al. |
| 6,258,207 | B1 | 7/2001 | Pan |
| 6,302,997 | B1 | 10/2001 | Hurter et al. |
| 6,455,129 | B1 | 9/2002 | Kershaw et al. |
| 6,511,579 | B1 | 1/2003 | Edwards et al. |
| 7,682,488 | B2 | 3/2010 | Yeh et al. |
| 8,049,060 | B2 | 11/2011 | Vinson et al. |
| 8,741,104 | B2 | 6/2014 | Edwards et al. |
| 10,132,036 | B2 | 11/2018 | Collins et al. |
| 10,145,066 | B2 * | 12/2018 | Shannon ..... A47K 7/00 |
| 10,145,069 | B2 | 12/2018 | Shannon et al. |
| 10,337,149 | B2 | 7/2019 | Rouse et al. |
| 2002/0148584 | A1 | 10/2002 | Edwards et al. |
| 2003/0192662 | A1 | 10/2003 | Heath et al. |
| 2004/0140076 | A1 | 7/2004 | Hermans et al. |
| 2004/0168780 | A1 | 9/2004 | Dwiggins et al. |
| 2004/0226673 | A1 | 11/2004 | Edwards et al. |
| 2005/0236122 | A1 | 10/2005 | Mullally et al. |
| 2007/0051484 | A1 | 3/2007 | Hermans et al. |
| 2007/0107863 | A1 | 5/2007 | Edwards et al. |
| 2008/0008853 | A1 | 1/2008 | Hupp et al. |
| 2010/0126685 | A1 | 5/2010 | Fike et al. |
| 2013/0068867 | A1 | 3/2013 | Hermans et al. |
| 2013/0068868 | A1 | 3/2013 | Hermans et al. |

(Continued)

FOREIGN PATENT DOCUMENTS

| | | | |
|---|---|---|---|
| EP | 2513372 | B1 | 3/2014 |
| GB | 1374198 | A | 11/1974 |

(Continued)

OTHER PUBLICATIONS

Eugenio et al., in "Evaluation of Hesperaloe funifera pulps obtained by a low energy consumption process as a reinforcement material in recycled pulps," Forest Systems 21(3) pp. 460-467. (Year: 2012).

Hurter, Robert W., in "Nonwood Plant Fiber Characteristics" HurterConsult pp. 1-4 (Year. 2001).

McLaughlin, Steven in "Properties of Paper Made From Fibers of Hesperaloe Funifera (Agavaceae)," Economic Botany, 54(2) pp. 192-196. (Year: 2000).

Economic Research Services: "Natural Fibers Hesperaloe Has Properties That Interest Papermakers", Sep. 1, 1996 (Sep. 1, 1996), XP055526919, Retrieved from the Internet: URL: https://www.ers.usda.gov/webdocs/publications/37342/32911_ius6d_002.pdf?v=41471 [retrieved on Nov. 26, 2018].

Deniz et al. in "Kraft and Modified Kraft Pulping of Bamboo (*Phyllostachys bambusoides*)," Drewno 2017, vol. 60, No. 200.

Protasio et al. in "Brazilian Lignocellulosic Wastes for Bioenergy Production: Characterization and Comparison with Fossil Fuels," BioResources 8(1), 1166-1185 (Year: 2013).

*Primary Examiner* — Jose A Fortuna

(74) *Attorney, Agent, or Firm* — Kimberly-Clark Worldwide, Inc.

(57) ABSTRACT

The present invention relates to tissue products comprising high yield *hesperaloe* fiber having improved wet performance, such as improved absorbency, CD Wet/Dry Ratio and CD Wet Durability. The addition of high yield *hesperaloe* pulp fibers surprisingly improves the CD Wet/Dry ratio without negatively affecting the absorbency of the tissue product. For example, tissue products of the present invention generally have an Absorbent Capacity greater than about 6.0 g/g, such as from about 6.0 to 8.0 g/g. As such the tissue products are durable when wet, but are still sufficiently absorbent. This balance of absorbency and wet strength is not found in the prior art without resorting to adding latex binders or the like to the tissue product.

18 Claims, No Drawings

(56) References Cited

U.S. PATENT DOCUMENTS

| | | | | |
|---|---|---|---|---|
| 2013/0071678 | A1 | 3/2013 | Shannon | |
| 2013/0199741 | A1 | 8/2013 | Stage et al. | |
| 2013/0269892 | A1 | 10/2013 | Hermans et al. | |
| 2014/0093704 | A1 | 4/2014 | Shi et al. | |
| 2014/0093705 | A1 | 4/2014 | Shi et al. | |
| 2014/0205777 | A1 | 7/2014 | Hawkins et al. | |
| 2014/0284010 | A1 | 9/2014 | Shannon | |
| 2015/0129143 | A1 | 5/2015 | Hawkins et al. | |
| 2018/0044859 | A1 | 2/2018 | Hermans et al. | |
| 2018/0135249 | A1* | 5/2018 | Shannon | A47K 7/00 |
| 2018/0142419 | A1 | 5/2018 | Rouse et al. | |
| 2018/0142420 | A1 | 5/2018 | Rouse et al. | |
| 2018/0142421 | A1 | 5/2018 | Rouse et al. | |
| 2019/0100878 | A1* | 4/2019 | Shannon | A47K 7/00 |

FOREIGN PATENT DOCUMENTS

| | | | |
|---|---|---|---|
| MX | 201000159 | A1 | 7/2011 |
| WO | WO2016195625 | A1 | 12/2016 |
| WO | WO2016195627 | A1 | 12/2016 |
| WO | WO2016195629 | A1 | 12/2016 |

* cited by examiner

HIGHLY DURABLE TOWEL COMPRISING NON-WOOD FIBERS

RELATED APPLICATIONS

The present application is a continuation application and claims priority to U.S. patent application Ser. No. 15/574,331, filed on Nov. 15, 2017, which is a national-phase entry, under 35 U.S.C. § 371, of PCT Patent Application No. PCT/US15/33175, filed on May 29, 2015, all of which are incorporated herein by reference.

BACKGROUND OF THE DISCLOSURE

In the development and manufacture of paper products, particularly paper towels for the consumer market, it is a continual objective to improve the absorbent characteristics of the product. For cleaning up some spills, the consumer needs high absorbent capacity. For some uses, consumers want a fast rate of absorbency. For other uses, a combination of high absorbent capacity and fast absorbent rate is desired. At the same time, constraints on achieving this objective include the need to maintain or reduce costs in order to provide the consumer with the highest possible value, which in part means minimizing the amount of fiber in the product.

SUMMARY OF THE DISCLOSURE

The present inventors have successfully used *hesperaloe* fibers to produce a tissue that is highly absorbent while also being durable when wet. As such the tissue products of the present invention may have an Absorbent Capacity greater than about 7.0 g/g and a CD Wet/Dry ratio greater than about 0.30. The desirable absorbency and wet durability are achieved by forming a tissue product from wood and non-wood fibers and more specifically high yield *hesperaloe* pulp fibers. In achieving these properties the inventors have overcome the negative to other important properties, such as bulk and stiffness, typically associated with substituting conventional wood papermaking fibers with non-wood fibers. As such, the tissue products of the present invention have properties comparable to or better than those produced using conventional wood papermaking fibers, and more particularly softwood fibers, and still more particularly Northern softwood kraft (NSWK) fibers.

Accordingly, in certain embodiments, the invention provides tissue products in which *hesperaloe* fibers replace at least about 50 percent of the NSWK, more preferably at least about 75 percent and still more preferably all NSWK while maintaining or improving absorbency and without negatively effecting stiffness and bulk.

In other embodiments the present invention provides tissue products comprising a multi-layered tissue web where one or more of the layers comprise a blend of *hesperaloe* fibers and softwood kraft fibers, wherein the softwood kraft fibers comprise less than about 10 weight percent of the tissue product.

In still other embodiments the present invention provides a tissue product comprising greater than about 20 weight percent high yield *hesperaloe* fiber, the tissue product having an Absorbent Capacity greater than about 7.0 g/g and a CD Wet/Dry Ratio greater than about 0.30.

In yet other embodiments the present invention provides single-ply through-air dried tissue product comprising at least about 20 weight percent high yield *hesperaloe* pulp fibers, the tissue product having a basis weight from about 30 to about 60 gsm, a GMT from about 1500 to about 2500 g/3" and an Absorbent Capacity greater than about 7.0 g/g.

In other embodiments the present invention provides tissue product comprising at least one multi-layered through-air dried tissue web comprising a first and a second layer, the first layer being substantially free from high yield *hesperaloe* pulp fibers and the second layer consisting essentially of high yield *hesperaloe* pulp fibers, the tissue product having a Wet CD Durability from about 1.75 to about 2.0 and a Stiffness Index less than about 6.0.

Definitions

As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 gsm, and in some embodiments from about 10 to about 60 gsm and more preferably from about 20 to about 50 gsm.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "basis weight" generally refers to the bone dry weight per unit area of a tissue and is generally expressed as grams per square meter (gsm). Basis weight is measured using TAPPI test method T-220.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 10 cc/g, more preferably greater than about 11 cc/g and still more preferably greater than about 12 cc/g.

As used herein, the term "fiber length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k}(x_i \times n_i)/n$$

where k=maximum fiber length
$x_i$=fiber length
$n_i$=number of fibers having length $x_i$
n=total number of fibers measured.

As used herein, the term "*hesperaloe* fiber" refers to a fiber derived from a plant of the genus *Hesperaloe* of the family Asparagaceae including, for example, *Hesperaloe funifera*. The fibers are generally processed into a pulp for use in the manufacture of tissue products according to the present invention. Preferably the pulping process is a high yield pulping process. The high yield *hesperaloe* pulp fibers generally have a lignin content, measured as Klason lignin, from about 10 to about 15 weight percent. The terms "*hesperaloe* fiber" and "high yield *hesperaloe* pulp fiber" may be used interchangeably herein when referring to non-wood fibers incorporated into tissue products, one skilled in the art will appreciate however that when incorporating non-wood fibers into tissue products it is preferred that the fibers be processed, such as by high yield pulping.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of grams per 3 inch sample width or g/3".

As used herein, the term "geometric mean slope" (GM Slope) generally refers to the square root of the product of machine direction slope and cross-machine direction slope. GM Slope generally is expressed in units of kg.

As used herein, the terms "geometric mean tensile" and "GMT" refer to the square root of the product of the machine direction tensile strength and the cross-machine direction tensile strength of the web. While the GMT may vary tissue products prepared according to the present disclosure generally have a GMT greater than about 1,400 g/3", such as from about 1,400 to about 2,500 g/3".

As used herein, the term "Stiffness Index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index may vary tissue products prepared according to the present disclosure generally have a Stiffness Index less than about 8.0 and more preferably less than about 6.0.

As used herein, the term "Absorbent Capacity" is a measure of the amount of water absorbed by the paper towel product in the vertical orientation and is expressed as grams of water absorbed per gram of fiber (dry weight). Absorbent Capacity is measured as described in the Test Methods section and generally has units of grams per gram (g/g). While the Absorbent Capacity may vary tissue products prepared according to the present disclosure generally have an Absorbent Capacity greater than about 6.0 g/g and more preferably greater than about 7.0 g/g.

As used herein the term "CD Wet/Dry Ratio," refers to the ratio of the wet CD tensile strength to the dry CD tensile strength, measured as described in the Test Methods Section, below. While the CD Wet/Dry Ratio may vary, tissue products prepared as described herein generally have a CD Wet/Dry Ratio greater than about 0.28 and more preferably greater than about 0.30, such as from about 0.28 to about 0.32. Generally the foregoing ratios are achieved at Wet CD Tensile greater than about 400 g/3", more preferably greater than about 425 g/3" and still more preferably greater than about 450 g/3".

As used herein the term "Wet CD Durability," refers to the CD Wet Stretch multiplied by 100, divided by the CD Wet Tensile (having units of g/3") and is a measurement of the wet CD extensibility of a product at a given wet tensile strength. At CD Wet Tensile strengths greater than about 400 g/3" the inventive tissue products of the present invention generally have Wet CD Durability greater than about 1.75 and more preferably greater than about 2.0.

As used herein the term "Wet Strength Efficiency," refers to the CD Wet/Dry Ratio divided by the add-on amount of wet strength resin (measured in kilograms per dry metric ton of fiber) multiplied by 100 and is a measure of the amount of wet strength generated relative to dry strength normalized by the amount of wet strength added.

DETAILED DESCRIPTION OF THE DISCLOSURE

Generally, the present invention provides tissue product having a CD Wet/Dry ratio that meets or exceeds satisfactory levels without the excess use of a wet strength resin. The satisfactory level of CD Wet/Dry ratio is generally greater than about 0.30. The satisfactory level of CD Wet/Dry ratio is surprisingly achieved by forming a tissue product from wood and non-wood fibers and more specifically high yield *hesperaloe* pulp fibers. Generally CD Wet/Dry ratios may be achieved with the addition of at least about 5 percent, by weight of the tissue product, such as from about 5 to about 50 percent and more preferably from about 15 to about 45 percent high yield *hesperaloe* pulp fibers.

The addition of high yield *hesperaloe* pulp fibers surprisingly improves the CD Wet/Dry ratio without negatively affecting the absorbency of the tissue product. For example, tissue products of the present invention generally have an Absorbent Capacity greater than about 6.0 g/g, such as from about 6.0 to 8.0 g/g. As such the tissue products are durable when wet, but are still sufficiently absorbent. This balance of absorbency and wet strength is not found in the prior art without resorting to adding latex binders or the like to the tissue product.

Further, the aforementioned wet-strength properties may be achieved with only modest additions of conventional wet-strength resin. For example, in certain embodiments the tissue products comprise less than about 15 kg of wet-strength resin per metric ton of furnish, such as from about 3 to about 15 kg, and more preferably from about 3 to about 10 kg. Rather than employ an excessive amount of wet-strength resin, the improved wet-strength properties are achieved by the addition of high yield *hesperaloe* pulp fibers during the manufacture of the tissue product, such as from about 5 to about 50 percent, by weight of the product, and more preferably from about 20 to about 40 percent, by weight.

Accordingly, in certain embodiments the tissue products generally comprise high yield *hesperaloe* pulp fibers derived from non-woody plants in the genus *Hesperaloe* in the family Agavaceae. Suitable species within the genus *Hesperaloe* include, for example *H. funifera, H. noctuma, H. parviflova,* and *H. changii*, as well as combinations thereof.

In certain embodiments the *hesperaloe* fibers are processed by a high yield pulping process, such as mechanically treating the fibers. High yield pulping process include, for example, mechanical pulp (MP), refiner mechanical pulp (RMP), pressurized refiner mechanical pulp (PRMP), thermomechanical pulp (TMP), high-temperature TMP (HT-TMP) RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of *hesperaloe* fibers using a high yield pulping process generally results in a pulp having a yield of at least about 85 percent, more preferably at least about 90 percent and still more preferably at least about 95 percent.

The high yield pulping process may comprise heating the *hesperaloe* fiber above ambient temperatures, such as from about to 100 to about 200° C. and more preferably from about 120 to about 190° C. while subjecting the fiber to mechanical forces. In other embodiments a caustic or oxidizing agent may be introduced to the process to facilitate fiber separation. For example, in one embodiment a 3-8 percent solution of NaOH may be added to the fiber during mechanical treatment. Although a caustic or oxidizing agent may be added during processing, it is generally preferred that the *hesperaloe* fiber is not pretreated with a chemical agent prior to processing. For example, high yield *hesperaloe* pulps are generally prepared without pretreatment of the fiber with an aqueous solution of sodium sulfite or the like, which is commonly employed in the manufacture of chemi-mechanical wood pulps.

Generally the high yield pulping process removes from about 1 to about 3 weight percent of the lignin from the *hesperaloe* fiber. As such high yield *hesperaloe* pulp useful in the present invention generally has a lignin content less than about 15 weight percent, preferably less than about 13 weight percent and still more preferably less than about 11 weight percent, such as from about 10 to about 15 weight percent.

In a particularly preferred embodiment *hesperaloe* fibers are utilized in the tissue web as a replacement for high fiber length wood fibers such as softwood fibers and more specifically NSWK or Southern softwood kraft (SSWK). In one particular embodiment the *hesperaloe* fibers are substituted for NSWK such that the total amount of NSWK, by weight of the tissue product, is less than about 10 percent and more preferably less than about 5 percent. In other embodiments it may be desirable to replace all of the NSWK with *hesperaloe* fibers such that the tissue product is substantially free from NSWK. In other embodiments *hesperaloe* fibers may be blended with SSWK fibers such that the total amount of SSWK, by weight of the tissue product, is less than about 10 percent and more preferably less than about 5 percent.

In addition to the use of high yield *hesperaloe* pulp fiber the tissue products of the present invention are preferably prepared without the addition of binders, particularly latex binders and more specifically carboxyl-functional latex emulsion polymers, such as those described in U.S. Pat. Nos. 6,187,140 and 7,462,258. Latex binders, such as those disclosed in the foregoing references, have been used previously in the manufacture of tissue products to improve wet performance. These binders, however, add manufacturing complexity and cost. Therefore, it is desirable to produce a tissue product, such as the inventive tissues, without the use of binders and more specifically latex binders.

Further, tissues prepared according to the present disclosure are not treated with a sizing agent, such as alkyl ketene dimer (AKD) or alkenyl succinic anhydride (ASA), either during the tissue manufacturing process or after formation and drying of the tissue web. Rather, the tissue webs are prepared by adding *hesperaloe* fibers and in certain embodiments a wet strength resin, to the papermaking furnish prior to formation of the web, to enhance the wet-strength properties of the finished web. Unlike conventional sizing agents, which reduce the adsorption rate of water into the sheet, *hesperaloe* fibers and conventional wet-strength resins allow the sheet to adsorb water as intended during the end use but maintain sheet integrity and strength when wetted.

Rather than employ latex binders or sizing agents, the tissue products typically comprise a conventional wet-strength resin. Useful conventional wet strength resins include diethylenetriamine (DETA), triethylenetetramine (TETA), tetraethylenepentamine (TEPA), epichlorhydrin resin(s), polyamide-epichlorohydrin (PAE), or any combinations thereof, or any resins to be considered in these families of resins. Particularly preferred wet strength resins are polyamide-epichlorohydrin (PAE) resins. Commonly PAE resins are formed by first reacting a polyalkylene polyamine and an aliphatic dicarboxylic acid or dicarboxylic acid derivative. A polyaminoamide made from diethylenetriamine and adipic acid or esters of dicarboxylic acid derivatives is most common. The resulting polyaminoamide is then reacted with epichlorohydrin. Useful PAE resins are sold under the tradename Kymene® (commercially available from Ashland, Inc., Covington, Ky.).

Generally the conventional wet-strength resin is added to the fiber furnish prior to formation of the tissue web. The amount of the wet-strength resin can be less than about 10 kg per ton of furnish, more preferably less than about 8 kg per ton of furnish and still more preferably less than about 5 kg per ton of furnish. Generally the add-on level of wet-strength resin will be from about 1 to about 10 kg per ton of furnish and more preferably from about 3 to about 8 kg per ton of furnish and still more preferably from about 3 to about 5 kg per ton of furnish.

Although such low add on levels of wet strength are generally not considered to be suitable for achieving exceptional wet performance, such as a CD Wet/Dry Ratio greater than about 0.30, it has now been discovered that the use of high yield *hesperaloe* pulp fibers yields tissue products having a CD Wet/Dry Ratio greater than about 0.30 and in certain embodiments greater than about 0.32, such as from about 0.30 to about 0.35. The combination of conventional wet strength resin, such as PAE resins, and *hesperaloe* fiber have a synergistic effect. Accordingly, when the CD Wet/

Dry Ratio and Wet CD Durability are concerned, the combination of wet-strength resin addition and *hesperaloe* fiber according to the invention provides a synergistic effect which has not been disclosed previously. This synergistic effect is valuable, since it makes it possible to achieve a higher wet-strength level without the excessive use of wet-strength resin.

Table 1 illustrates the desirable increase in wet-strength properties that can be achieved via the combination of high yield *hesperaloe* fiber (HYH) and a conventional wet-strength resin. The samples have a basis weight of about 36 gsm and comprised a single through-air dried ply. The samples comprised either a blend of NSWK (40 wt %) and EHWK (60 wt %) or HYH (40 wt %) and EHWK (60 wt %). As the table illustrates, at a constant level of wet-strength addition, a higher wet/dry tensile level can be achieved via the addition of HYH.

TABLE 1

| HYH (wt %) | Wet Strength (kg/MT) | CD Wet/Dry Ratio | Delta CD Wet/Dry Ratio (%) | Wet Strength Efficiency |
|---|---|---|---|---|
| — | 9 | 0.22 | — | 2.4 |
| 40 | 9 | 0.3 | 36 | 3.3 |
| — | 14 | 0.24 | — | 1.7 |
| 40 | 14 | 0.31 | 29 | 2.2 |

The improvement in wet tensile properties is further evident when the inventive tissue products are compared to commercially available tissue products. As illustrated in the table below, the inventive tissue products display both wet durability, such as a CD Wet/Dry Ratio greater than about 0.30 and good absorbency, such as an Absorbent Capacity greater than about 6.0 g/g and more preferably greater than about 7.0 g/g, such as from about 6.0 to about 7.5 g/g. In certain aspects the inventive tissue products also have improved Wet CD Durability relative to commercially available tissue products, such as a Wet CD Durability greater than about 1.5 and more preferably greater than about 1.75, such as from about 1.5 to about 2.0.

TABLE 2

| Product | Plies | Wet CD Tensile (g/3") | Wet CD Stretch (%) | CD Wet/Dry Ratio | Wet CD Dura-bility | Absorbent Capacity (g/g) |
|---|---|---|---|---|---|---|
| Invention | 1 | 418 | 8.2 | 0.32 | 1.96 | 7.1 |
| Scott | 1 | 855 | 7.5 | 0.34 | 0.88 | 5.5 |
| Scott Naturals | 1 | 811 | 11.3 | 0.33 | 1.39 | 4.7 |
| Viva Vantage | 1 | 969 | 8.2 | 0.34 | 0.85 | 3.9 |
| Bounty Basic | 1 | 1040 | 7.2 | 0.47 | 0.69 | 4.9 |

Accordingly, in one embodiment tissue products comprise at least one multi-layered tissue web, the tissue product having a CD Wet/Dry Ratio greater than about 0.30 an Absorbent Capacity greater than about 6.0 g/g and still more preferably greater than about 6.5 g/g. Preferably the web comprises two layers, and more preferably three layers, wherein the *hesperaloe* fiber is selectively disposed in only one of the layers and the other layers are substantially free from *hesperaloe* fiber. In other embodiments, the web comprises two outer layers and a middle layer, where the *hesperaloe* fiber is selectively disposed in the middle layer. While in one embodiment it is preferred that the tissue web comprise a three-layered tissue having *hesperaloe* fiber selectively incorporated into the middle layer, it should be understood that tissue products made from the foregoing multi-layered web can include any number of plies and the plies may be made from various combinations of single- and multi-layered tissue webs. Further, tissue webs prepared according to the present invention may be incorporated into tissue products that may be either single- or multi-ply, where one or more of the plies may be formed by a multi-layered tissue web having *hesperaloe* fibers selectively incorporated in one of its layers.

As noted previously, the instant tissue products have a high degree of absorbent capacity such as an Absorbent Capacity greater than about 6.0 g/g, such as from about 6.0 to about 7.0 g/g and more preferably from about 6.5 to about 7.0 g/g, while also having a CD Wet/Dry Ratio greater than about 0.30, such as from about 0.30 to about 0.40. Generally the foregoing absorbent capacities and wet strengths are achieved at basis weights from about 30 to about 60 grams per square meter (gsm) and more preferably from about 35 to about 50 gsm and still more preferably from about 40 to about 50 gsm.

In addition to having satisfactory absorbent properties, the tissue products generally have improved wet CD performance. For example, in certain embodiments the tissue products have a Wet CD Durability greater than about 1.75, such as from about 1.75 to about 2.5 and more preferably from about 2.0 to about 2.5. At the foregoing Wet CD Durability levels the tissue products may have a Wet CD Stretch greater than about 8.0 percent, such as from about 8.0 percent to about 10.0 percent and more preferably from about 9.0 to about 10.0 percent.

While having improved properties, the tissue products prepared according to the present disclosure continue to be strong enough to withstand use by a consumer. For example, inventive tissue products generally have a geometric mean tensile (GMT) greater than about 1200 g/3", such as from about 1200 to about 3000 g/3", more preferably from about 1200 to about 2500 g/3" and still more preferably from about 1600 to about 2400 g/3".

Not only are the instant tissue products absorbent and strong enough to withstand use, they are generally flexible and have good hand feel. As such the tissue products may have a GM Slope less than about 10.0 kg, such as from about 4.0 to about 10.0 kg and more preferably from about 4.0 to about 8.0 kg. The foregoing GM Slopes are generally achieved at relatively modest GMT, such as from about 1200 to about 2500 g/3", and more preferably from about 1200 to about 2200 g/3". At these GM Slopes and GMT, the tissue products may have a Stiffness Index less than about 8.0, such as from about 4.0 to about 8.0 and more preferably from about 4.0 to about 6.0.

In one particularly preferred embodiment the inventive tissue product comprises a single-ply, multi-layered, through-air-dried web, wherein a first layer comprises wood pulp fibers and a second layer comprises high yield *hesperaloe* pulp fibers, the first layer being substantially free of *hesperaloe* fibers and the product comprising from about 20 to about 50 percent, by weight, *hesperaloe* fibers. The foregoing tissue product generally has a CD Wet/Dry Ratio greater than about 0.30 an Absorbent Capacity greater than about 6.0, while having a Stiffness Index less than about 6.0, such as from about 4.0 to about 6.0.

Webs useful in preparing tissue products according to the present disclosure can vary depending upon the particular application. In general, in addition to *hesperaloe* fibers, the webs can be made from any suitable type of fiber. For instance, the base web can be made from cellulosic fibers, and more preferably cellulosic pulp fibers. Suitable cellulosic fibers for use in connection with this invention include secondary (recycled) papermaking fibers and virgin papermaking fibers in all proportions. Such fibers include, without limitation, hardwood and softwood fibers.

Tissue webs made in accordance with the present disclosure can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web. Generally the *hesperaloe* fibers will comprise from about 5 to about 50 percent, by weight, of the web.

The tissue products of the present disclosure can generally be formed by any of a variety of papermaking processes known in the art. Preferably the tissue web is formed by through-air drying and be either creped or uncreped. For example, a papermaking process of the present disclosure can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present disclosure. When forming multi-ply tissue products, the separate plies can be made from the same process or from different processes as desired.

In a particularly preferred embodiment at least one web of the tissue product is formed by an uncreped through-air drying process, such as the process described, for example, in U.S. Pat. Nos. 5,656,132 and 6,017,417, both of which are hereby incorporated by reference herein in a manner consistent with the present disclosure.

In one embodiment the web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and more specifically between about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 30 to about 70 percent and more preferably from about 40 to about 60 percent. This is commonly referred to as "rush transfer". During rush transfer many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

In addition to rush transferring the wet tissue web from the transfer fabric to the through-air drying fabric, the wet tissue web may be macroscopically rearranged to conform to the surface of the through-air drying fabric with the aid of a vacuum transfer roll or a vacuum transfer shoe. If desired, the through-air drying fabric can be run at a speed slower than the speed of the transfer fabric to further enhance MD stretch of the resulting absorbent tissue product. The transfer may be carried out with vacuum assistance to ensure conformation of the wet tissue web to the topography of the through-air drying fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

Test Methods

Wet and Dry Tensile

Samples for tensile strength testing are prepared by cutting a 3 inches (76.2 mm) by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/mnin (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

Wet tensile strength measurements are measured in the same manner, but after the center portion of the previously conditioned sample strip has been saturated with distilled water immediately prior to loading the specimen into the tensile test equipment. More specifically, prior to performing a wet CD tensile test, the sample must be aged to ensure the wet strength resin has cured. Two types of aging were practiced: natural and artificial. Natural aging was used for older samples that had already aged. Artificial aging was used for samples that were to be tested immediately after or within days of manufacture. For natural aging, the samples were held at 73° F., 50 percent relative humidity for a period of 12 days prior to testing. Following this natural aging step, the strips are then wetted individually and tested. For artificially aged samples, the 3-inch wide sample strips were heated for 4 minutes at 105±2° C. Following this artificial aging step, the strips are then wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4-inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry CD tensile test, the characterization of a product is determined by the average of at least six, but in the case of the examples disclosed, twenty representative sample measurements.

Absorbency

As used herein, "vertical absorbent capacity" is a measure of the amount of water absorbed by a paper product (single-ply or multi-ply) or a sheet, expressed as grams of water absorbed per gram of fiber (dry weight). In particular, the vertical absorbent capacity is determined by cutting a sheet of the product to be tested (which may contain one or more plies) into a square measuring 100 millimeters by 100 millimeters (±1 mm.) The resulting test specimen is weighed to the nearest 0.01 gram and the value is recorded as the "dry weight." The specimen is attached to a 3-point clamping device and hung from one corner in a 3-point clamping device such that the opposite corner is lower than the rest of the specimen, then the sample and the clamp are placed into a dish of water and soaked in the water for 3 minutes (±5 seconds). The water should be distilled or de-ionized water at a temperature of 23±3° C. At the end of the soaking time, the specimen and the clamp are removed from the water. The clamping device should be such that the clamp area and pressure have minimal effect on the test result. Specifically, the clamp area should be only large enough to hold the sample and the pressure should also just be sufficient for holding the sample, while minimizing the amount of water removed from the sample during clamping. The sample specimen is allowed to drain for 3 minutes (±5 seconds). At the end of the draining time, the specimen is removed by holding a weighing dish under the specimen and releasing it from the clamping device. The wet specimen is then weighed to the nearest 0.01 gram and the value recorded as the "wet weight". The vertical absorbent capacity in grams per gram=[(wet weight−dry weight)/dry weight]. At least five (5) replicate measurements are made on representative samples from the same roll or box of product to yield an average vertical absorbent capacity value.

EXAMPLE

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Inventive base sheets were produced from a furnish comprising northern softwood kraft (NSWK), eucalyptus kraft (EHWK) and high yield *hesperaloe* fiber (HYH) using a layered headbox fed by three stock chests such that the webs having three layers (two outer layers and a middle layer) were formed. The outer layers comprised 100 percent EHWK for both the control and inventive samples. The center layer was 100 percent NSWK for the control sample; for the inventive sample, the center layer was 100 percent HYH. The layer splits, by weight of the web, are detailed in Table 3, below.

The HYH was prepared by dispersing about 50 pounds (oven dry basis) HYH pulp in a pulper for 30 minutes at a consistency of about 3 percent. The fiber was then transferred to a machine chest and diluted to a consistency of 1 percent. HYH was produced by processing *H. Funifera* using a three stage non-wood pulping process commercially available from Taizen America (Macon, Ga.). The *hesperaloe* was not refined. The *hesperaloe* had an average fiber length of about 1.85 mm and a fiber coarseness of about 5.47 mg/100 m.

The tissue web was formed on a Voith Fabrics TissueForm V forming fabric, vacuum dewatered to approximately 25 percent consistency and then subjected to rush transfer when transferred to the transfer fabric. The layer splits, by weight of the web, are detailed in Table 4, below. The transfer fabric was the fabric described as t1207-11 (commercially available from Voith Fabrics, Appleton, Wis.). The web was then transferred to a through-air drying fabric. Transfer to the through-drying fabric was done using vacuum levels of greater than 10 inches of mercury at the transfer. The web was then dried to approximately 98 percent solids before winding.

TABLE 3

| Sample | Layer Split (Air/Middle/Fabric wt %) | HYH (wt %) | Wet Strength (kg/MT) |
|---|---|---|---|
| Control | 30/40/30 | — | 8 |
| Inventive 1 | 30/40/30 | 40 | 8 |

The base sheet webs were converted into rolled towel products by calendering using a conventional polyurethane/steel calender comprising a 4 P&J polyurethane roll on the air side of the sheet and a standard steel roll on the fabric side. The finished product comprised a single ply of base sheet. The finished products were subjected to physical testing, the results of which are summarized in Table 4.

TABLE 4

| | Control 1 | Inventive 1 |
|---|---|---|
| BW (gsm) | 39.3 | 39.0 |
| Wet CDT (g/3") | 515 | 418 |
| Wet CDS (%) | 10.7 | 8.2 |
| Wet CD Durability | 2.08 | 1.96 |
| CD Wet/Dry | 0.31 | 0.31 |
| Absorbent Capacity (g/g) | 6.2 | 7.1 |
| Wet Strength Efficiency | 3.89 | 3.89 |
| Dry GMT (g/3") | 2217 | 1821 |
| Dry CDT (g/3") | 1655 | 1340 |
| Dry GM Slope (kg) | 7.2 | 7.7 |
| Stiffness Index | 3.25 | 4.23 |

The foregoing is one example of an inventive tissue product prepared according to the present disclosure. In a first embodiment the invention provides a tissue product comprising greater than about 20 weight percent high yield *hesperaloe* fiber having an Absorbent Capacity greater than about 7.0 g/g and a CD Wet/Dry Ratio greater than about 0.30.

In a second embodiment the invention provides the tissue product of the first embodiment having a Wet CD Durability of greater than about 1.75.

In a third embodiment the invention provides the tissue product of the first embodiment having an Absorbent Capacity from about 7.0 to about 7.5 g/g, a CD Wet/Dry Ratio from about 0.30 to about 0.35.

In a third embodiment the present invention provides the tissue product of the first or the second embodiments having a GMT from about 1200 to about 2600 g/3".

In a fourth embodiment the present invention provides the tissue product of any one of the first through the third embodiments having a Stiffness Index from about 4.0 to about 6.0.

In a fifth embodiment the present invention provides the tissue product of any one of the first through the fourth embodiments having a basis weight from about 34 to about 60 gsm.

In a sixth embodiment the present invention provides the tissue product of any one of the first through the fifth embodiments having wet CD stretch greater than about 8 percent, such as from about 8 to about 10 percent.

In a seventh embodiment the present invention provides the tissue product of any one of the first through the sixth embodiments wherein the tissue product comprises a single-ply multi-layered web having a first, a second and a third layer.

In an eighth embodiment the present invention provides the tissue product of any one of the first through the seventh embodiments wherein the tissue product comprises from about 20 to about 50 weight percent high yield *hesperaloe* fiber.

In a ninth embodiment the present invention provides the tissue product of any one of the first through the eighth embodiments wherein the tissue product comprises at least one through-air dried tissue web.

In a tenth embodiment the present invention provides the tissue product of any one of the first through the ninth embodiments wherein the tissue product comprises at least one multi-layered through-air dried tissue web.

In still other embodiments the disclosure provides a tissue product of any one of the foregoing embodiments wherein the tissue product comprises at least one multi-layered through-air dried tissue web comprising a first fibrous layer and a second fibrous layer, the first fibrous layer comprising wood pulp fibers and the second fibrous layer consisting essentially of high yield *hesperaloe* fibers and wherein the *hesperaloe* fibers comprise from about 20 to about 40 weight percent of the through-air dried web.

What is claimed is:

1. A tissue product comprising wood pulp fibers and from about 5 to about 50 weight percent high yield *hesperaloe* pulp fibers, the tissue product having a CD Wet/Dry ratio greater than about 0.30 and a Wet CD Durability greater than about 1.75.

2. The tissue product of claim 1 comprising from about 15 to about 45 weight percent high yield *hesperaloe* pulp fibers.

3. The tissue product of claim 1 comprising less than about 10 weight percent Northern softwood kraft pulp fibers.

4. The tissue product of claim 1 comprising from about 3 to about 10 kg of wet-strength resin per ton of wood pulp fibers and high yield *hesperaloe* pulp fibers.

5. The tissue product of claim 1 having a geometric mean tensile strength (GMT) from about 1,500 to about 3,000 g/3".

6. The tissue product of claim 1 having a Stiffness Index from about 4.0 to about 6.0.

7. The tissue product of claim 1 having a basis weight from about 30 to about 60 grams per square meter (gsm) and Absorbent Capacity from about 6.0 to about 7.0 g/g.

8. The tissue product of claim 1 having a wet CD stretch greater than about 8.0 percent.

9. The tissue product of claim 1 having a Wet CD Durability from about 1.75 to about 2.5.

10. The tissue product of claim 1 having a basis weight from about 30 to about 60 gsm, a GM Slope from about 4.0 to about 10 kg and a GMT from about 1,200 to about 2,200 g/3".

11. The tissue product of claim 1 wherein the tissue product comprises two plies and each ply is a through-air dried tissue web.

12. The tissue product of claim 1 wherein the tissue product comprises two plies and each ply is a multi-layered through-air dried tissue web comprising a first layer consisting essentially of hardwood kraft pulp fibers and a second layer comprising high yield *hesperaloe* pulp fibers.

13. A single-ply through-air dried tissue product comprising wood pulp fibers and from about 5 to about 50 weight percent high yield *hesperaloe* pulp fibers, the tissue product having a basis weight from about 30 to about 60 gsm, a GMT greater than about 1,200 g/3", a CD Wet/Dry ratio greater than about 0.30 and a Wet CD Durability greater than about 1.75.

14. The tissue product of claim 13 comprising from about 15 to about 45 weight percent high yield *hesperaloe* pulp fibers.

15. The tissue product of claim 13 comprising less than about 10 weight percent Northern softwood kraft pulp fibers.

16. The tissue product of claim 13 comprising from about 3 to about 10 kg of wet-strength resin per ton of wood pulp fibers and high yield *hesperaloe* pulp fibers.

17. The tissue product of claim 13 having a GMT from about 1,500 to about 3,000 g/3" and a Stiffness Index from about 4.0 to about 6.0.

18. The tissue product of claim 13 having an Absorbent Capacity from about 6.0 to about 7.0 g/g.

* * * * *